United States Patent [19]

Katzmarzik

[11] Patent Number: 4,687,460

[45] Date of Patent: Aug. 18, 1987

[54] GRAVITATIONALLY ANIMATED TOY BIRD

[76] Inventor: Frank J. Katzmarzik, 206 Union Ave., Belleville, Ill. 62220

[21] Appl. No.: 843,519

[22] Filed: Mar. 25, 1986

[51] Int. Cl.[4] ..... A63H 15/02

[52] U.S. Cl. ..... 446/316; D21/150; D21/160

[58] Field of Search ..... 446/316, 317, 351; D21/160, 150; 30/120.2, 120.3, 120.5; D7/98

[56] References Cited

U.S. PATENT DOCUMENTS 2,601,739 7/1952 Nicholls ..... 446/313
3,491,814 1/1970 Marcinek et al. ..... D7/98 X

FOREIGN PATENT DOCUMENTS 712577 11/1942 Fed. Rep. of Germany ..... 446/316
929615 1/1948 France ..... 446/316

*Primary Examiner*—Robert A. Hafer
*Assistant Examiner*—Terrence L. B. Brown

[57] ABSTRACT

A gravitationally animated toy bird comprised of three main body members axially connected to permit an inner body member to pivotally swing about the axis is disclosed. The gravitationally animated toy bird when released at the top of an inclined plane will simulate four movements of a bird, including its mandibles opening and closing, its tail feathers waggling up and down, its head plume feathers waggling forward and backwards, and its legs walking down the inclined plane.

5 Claims, 6 Drawing Figures

GRAVITATIONALLY ANIMATED TOY BIRD

BACKGROUND OF THE INVENTION

In the past, a number of amusement devices, notably toys and accessories therefor, have been constructed for walking down inclined surfaces.

For example, U.S. Pat. No. 2,035,624, entitled "Toy", issued Mar. 31, 1936, to Mr. William D. Torme. Although this toy when tipped slightly would lock while allowing one foot to move in advance of the other alternatively, the toy required a spring member and in order to function properly, required arched limb members, thin elastic and resilient joint members, and silhouetted folding pieces that were unstable and inoperative without the requisite additional elements.

Also, U.S. Pat. No. 1,768,174, entitled "Gravity Operated Figure Toy", issued June 24, 1930, to Mr. J. N. Vasconcellos. This toy likewise when disposed on inclined planes with the heel of its foreleg and lower edges of hind paw engaging the surface, resulted in an overbalanced body which moved forward by gravity. However, these toys simulated only the moving of the animals legs and main body portions, without any further animated aspects of the toy animals anatomy.

U.S. Pat. No. 1,610,039, entitled "Toy", issued Dec. 7, 1926, to Mr. Ray W. Dover. Although the toy simulated the opening and closing of alligator's jaws while hopping down an inclined plane, it required the use of lug members on the lower face and outer end of the toy jaws and jaw hinges, complicating the manufacture of the toy and requiring a number of detailed embodiments to facilitate its construction.

U.S. Pat. No. 1,154,088, entitled "Gravity Travelling Toy", issued Sept. 21, 1915, to Mr. Joseph T. Breneman. This patent was drawn to a toy monkey whose legs rocked forward and swiveled alternatively while the monkey descended down an inclined plane. Again, the only portions of the monkey's anatomy which were animated were its legs and four separate leg appendages were required. The movement of the legs required lugs laterally and inwardly extending from the back of the forelegs and engaging with the rear thereof upon the forward swinging of the legs.

U.S. Pat. No. 2,035,353, entitled "Animated Toy", issued Mar. 24, 1936, also to Mr. W. D. Torme. Although Mr. Torme did depict an animated bird which walked down an incline, several connecting parts with a multiplicity of slots and tabs were required for construction of the animated bird. Additionally, to balance the animated bird, it was necessary to position its two leg members side by side. Additionally, for the swaying or wobbling movement to be effectively balanced, the toy required metal bow springs.

Additional patents related to amusement devices and toys constructed for walking down inclines include U.S. Pat. Nos. 4,237,648; 3,509,661; 3,100,946; 2,965,385; 2,932,824; 2,861,390; 2,618,895; 2,140,275; 2,108,345; 2,021,588; 2,001,013; 1,947,343; 1,633,147; 1,633,146; 1,608,648; 1,538,217; 1,421,694; 1,136,707; 1,007,218; 612,467; 435,796; 376,588; and Re. 13,696.

The discovery of a gravitationally animated toy with a bare minimum number of parts, yet having a multiplicity of attractively amusing animated parts would be a substantial advancement in the art.

SUMMARY OF THE INVENTION

A principle object of the instant invention is the provision of four animated parts including leg members, mouth members, tail members and head members, while having only three main parts for assembly about a single pivot pin.

Another object of the invention is provision of a simple and amusing toy which can be speedily and economically mass produced, while being attractive to infant consumers.

The foregoing and other objects of this invention which will become apparent, are attained by axially connecting an inner body member having one leg appendage, one mouth or beak appendage, one plume appendage, and one tail appendage; all of which are sandwiched between an ornamental side body member and a functional side body member. The ornamental side body member comprises a head plume member and a tail member. The functional side body member comprises a plume appendage, a beak appendage, one leg member appendage, a tail appendage, and two inner abutments for restricting the movement of the inner body member.

DETAILED DESCRIPTION OF THE DRAWINGS

Figure 1:
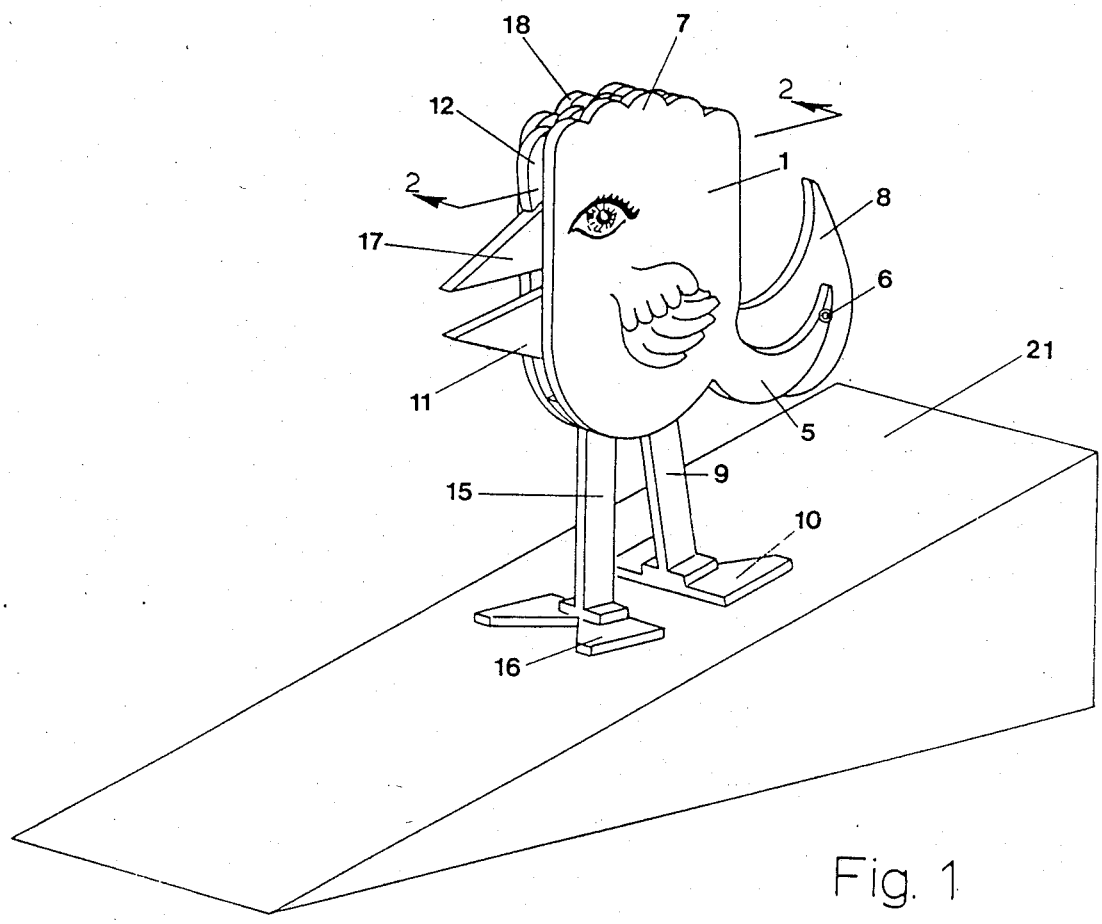
FIG. 1 is a perspective view of the gravitationally animated toy bird on the surface of an inclined plane.
Figure 2:
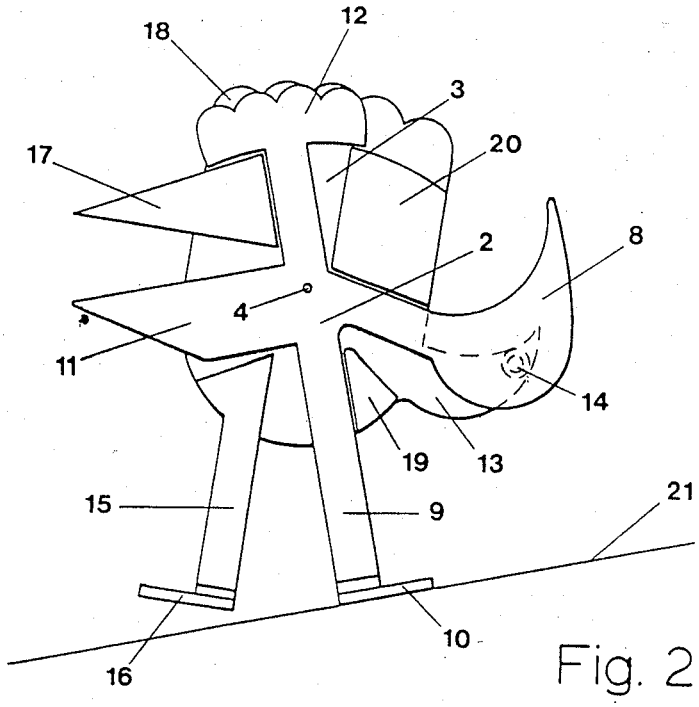
FIG. 2 is a cross-sectional view of the gravitationally animated toy bird with its ornamental side member removed, thus illustrating the view along line 2—2 of FIG. 1, looking in the direction indicated by the arrows, and clearly showing the construction of the inner body member and the functional body side member.

Referring particularly to FIGS. 1 and 2, the gravitationally animated toy bird comprising the invention is illustrated, it being understood, however, that with respect to the toy bird, only elements essential to an understanding of the invention have been included. The parts shown include an ornamental body side member, 1 comprising a single plate having ornamental painting or decals on its surface to depict, for example, an eye and a wing. The ornamental body side member 1 is defined in its top by a series of ripples simulating outer plume feathers 7, and having an appendage at its bottom rear simulating its outer tail 5, and a weight 6 on its tail.

Referring particularly to FIG. 2, the inner body member 2 is illustrated as axially affixed to the functional side body member 3, solely by a pivot pin 4. The inner body member 2 is defined by four appendages, an inner tail 8, an inner plume feather member 12, a lower mandible member 11, and a rear leg member 9. The rear leg member has a foot member simulating a webbed foot 10, the shape of which is more readily apparent from FIG. 1. The outer surface of the functional side body member 3 although not shown may be ornamentally decorated to duplicate the outer surface of the ornamental body side member 1, as illustrated in FIG. 1. The functional body side member is defined by four appendages and two inner abutments. Those appendages include a tail member 13 bearing a weight 14 and affix parallel to while being shaped and colored identical to the tail member 5 of the ornamental body side member, a front leg member 15 having attached to its base a front webbed foot member 16 whose shape is more readily apparent in FIG. 1, a top mandible member 17, a series of outer head plume feathers 18. The abutments include a lower abutment 19 for restricting the movement of the rear leg member 9 and an upper abutment 20 for restricting the movement of the inner plume feathers 12.

Figure 5:
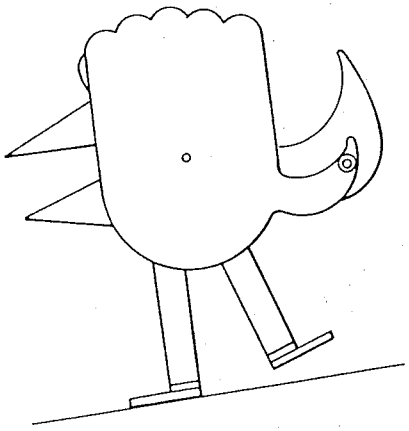
Figure 4:
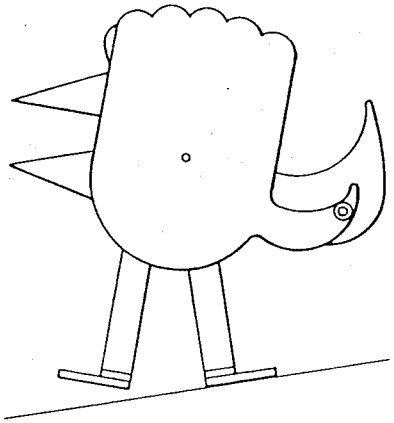
Figure 3:
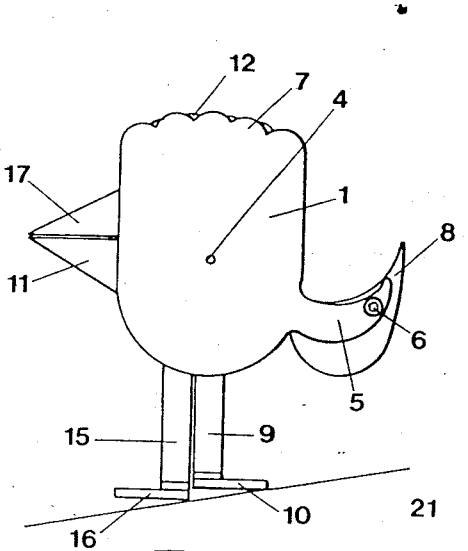

In the operation of the gravitationally animated toy bird, movement may be initiated by releasing the toy onto the surface of an inclined plane at the position illustrated in FIG. 3. Since the rear leg member 9 is shorter than the front leg member 15, as the rear webbed member 10 comes to rest on the surface of the inclined plane 21 the weighted tails 5 and 13 descend from the momentum of the bird's rear foot coming to rest flatly on the surface. The descending movement of the weighted tail members pulls or pivots the front leg member 15 forward and upward as in a teeter-totter, raises the upper beak member 17 and actuates the plume feathers 7 and 18 of the body side members in a rearward movement. These actions are illustrated in FIGS. 2 and 4 which are identical steps in the sequence of the toy bird's movement. FIG. 2 illustrates the inner actions which have taken place as the forward leg 15 kicks forward. You will note that the force and momentum of the rear leg member 9 contacting the abutment 19 and that of the top beak member 17 striking the lower end of the inner plume feather member 12 together with the force and momentum of the abutment 20 striking the base of the inner feather member 8 acts with the force of gravity to urge the center of gravity of the toy bird forward. As the bird rocks forward into the position illustrated at FIG. 5, its front leg member 15 drops until the front webbed foot 16 comes to rest on the surface of the inclined plane 21. This action lifts the rear leg member 9 from the surface of the inclined plane 21, urges the weighted tail into an ascending position and provides the momentum necessary for the rear leg member to swing forward in a pivotal manner similar to that of a teeter-totter. Eventually the rear leg member 9 swings until it contacts the rear of the front leg member 15 which, in turn, causes the lower beak 11 to move upward until it contacts the upper beak 17 and the inner plume 12 moves rearward in a clockwise position until it strikes the abutment 20. The impact of these elements striking their respective abutments together with the force of gravity and the weigth at the tail of the toy bird serves to create a rearward imbalance to the toy bird which, in turn, leads to the bird rocking in a rearward position until its rear webbed member 10 strikes the inclined plane and the cycle thereafter repeats itself since the toy bird will now be in the position illustrated at FIG. 3.

Figure 6:
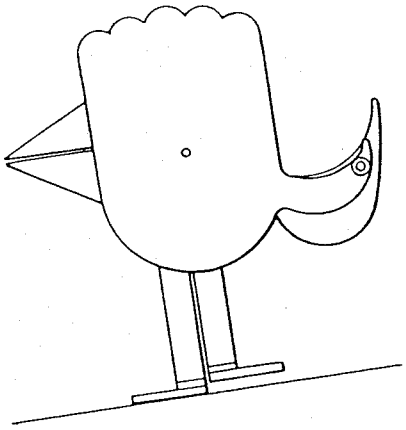
FIGS. 3 through 6 show side views of the gravitationally animated toy bird in sequential order of its movements, beginning with its being released onto the inclined plane and the order of its movements thereafter ending with FIG. 6 which is the last movement prior to the cycle repeating itself.

It is important for the proper operation of the gravitationally animated toy bird that the rear leg member and the front leg member be properly proportioned in length and that the weight at the tail of the bird provide the appropriate balancing action to coincide with the angle of incline of the plane. Where the angle of incline of the plane ranges from 5° to 10°, it will be noted that no more than one-eighth inch difference in length between the rear leg member and the front leg member will be adequate. Such a length differential permits for example the rear webbed foot member 10 to rest flat on a horizontal plane while the body tilts backward but remains balanced, preferably the front leg member kicks forward to a position where the heel of the front webbed member 16 rests on the horizontal plane while the toe of the front webbed member is at an inclined position. It is at this angle of difference in the legs that the abutment 19 is most effectively placed to restrict movement of the parts. Additionally, the abutment 20 is placed into position at this point. The weight in the rear tail member should be such that at an angle of incline of between 5° and 10°, when the front webbed foot member 16 rests on the surface of that inclined plane, the weight is sufficient to prevent the toy bird from tipping any further forward while also slightly balancing the overall bird in a rearward position. This permits the toy bird when in the position illustrated at FIG. 6 to tilt backward. The precise weight will depend upon the material of construction of the toy bird itself.

The toy bird may be constructed of any commercially available material, preferably lightweight plastic capable of injection molding, however, material of construction could also be plywood, rubber of other synthetic materials available for the manufacture of toys and amusement devices.

It may be desirable to provide a bright contrasting series of colors for the wing, bird's eyes, mandibles and legs, inner and outer tails, as well as inner and outer head plume feathers. In an especially preferred embodiment of the toy bird, it may be the inner tail is a color which offers a stark contrast to the outer tail while the inner tail's color, however, is the same as the inner plume color. The outer plume feathers would be colored to match the outer tail feathers, thus, offering an important feature of the invention for the amusement of children when and if such amusement is desired.

As will be apparent from the foregoing description of the invention, other characters, including for example objects, human beings or animals may be animated in gravitational toy construction by slight modifications of the present invention, all of which is contemplated by the inventor. Anything for example may be driven by a radial member not necessarily a beak, tail or head. The key aspect of the invention are the integral workings of the three main body members axially connected by a pivot pin.

Having thus described the invention in rather full detail, it will be understood that these details need not be strictly adhered to and that various changes and modifications may be made, all falling within the scope of the invention.

What is claimed is:

1. A gravitationally animated toy bird having three body members axially affixed by a pivot pin; the three body members comprising:

(a) An ornamental body side member having a weighted tail at its bottom rear and a simulated plume at its top;

(b) An inner body member axially affixed to the ornamental side member so as to pivot or swing about the axis of the pivot pin, said inner body member comprising four radial appendages defining, (i) a single rear leg member having at its base a flat member defining a webbed foot with toes directed towards the rear of the webbed foot, (ii) a lower mandible, (iii) an inner tail member, and (iv) an inner plume member; the body members further comprising;

(c) a functional body side member axially affixed about the pivot pin to sandwich the inner body member between said functional body side member and said ornamental body side member while secured to remain stationary relative to the ornamental body said member but pivotally movable relative to the said inner body member, said functional body side member comprising the following appendages; (i) a front leg member having a webbed foot member with toes directed forward of the leg member, (ii) a top mandible member, (iii) a top outer plume member, (iv) an abutment opposite of the top beak member, the two of which create a slot within which the inner plume member abuts and thereby has its degree of movement restricted, (v) a weighted tail member at its rear in parallel relationship to the weighted tail member of the ornamental body side member, and (vi) an abutment to define the maximum rear movement of the rear leg member appended to the inner body member, said forward leg member being longer than said rear leg member in length, and said forward leg representing an abutment defining the maximum forward movement of the pivotally attached rear leg member of the inner body; whereby said gravitationally animated toy bird can simulate a bird walking down an incline with its tail feathers flicking, its mandibles opening and closing, and its plume feathers moving backward and forward.

2. The gravitationally animated toy bird of claim 1 wherein the tail members of the ornamental side member and the functional side member are of equal weight, and balanced such that the toy bird when resting its rear webbed member flat against a horizontal plane, the weight pulls the front leg member forward without tilting the toy off of its rear webbed member.

3. The gravitationally animated toy bird of claim 1 wherein the rear leg member is about one-eigth of an inch shorter than the front leg member.

4. The gravitationally animated toy bird of claim 1 wherein the two leg members are restricted against their respected abutments so that when the toy bird rests on a horizontal plane with its rear webbed member flat against the surface of the horizontal plane, the body will tilt backward but remains balanced.

5. The gravitationally animated toy bird of claim 1 wherein the inner plume and inner tail member of the inner body member are a color which provides a contrast against the color of the outer tail members and outer plume members of the ornamental body side member and the functional body side member.

* * * * *